US009916783B2

(12) United States Patent
Ashworth et al.

(10) Patent No.: US 9,916,783 B2
(45) Date of Patent: Mar. 13, 2018

(54) BANNER SUPPORT ASSEMBLY

(71) Applicant: Wheels Automotive Dealer Supplies Inc., Stoney Creek (CA)

(72) Inventors: Rick Ashworth, Stoney Creek (CA); Scott Kobryn, Niagara-on-the-Lake (CA)

( * ) Notice: Subject to any disclaimer, the term of this patent is extended or adjusted under 35 U.S.C. 154(b) by 0 days.

(21) Appl. No.: 15/452,983

(22) Filed: Mar. 8, 2017

(65) Prior Publication Data

US 2017/0287372 A1 Oct. 5, 2017

Related U.S. Application Data

(60) Provisional application No. 62/316,026, filed on Mar. 31, 2016.

(51) Int. Cl.
*G09F 17/00* (2006.01)
*G09F 7/18* (2006.01)

(52) U.S. Cl.
CPC ..... *G09F 17/00* (2013.01); *G09F 7/18* (2013.01); *G09F 2007/1817* (2013.01); *G09F 2007/1856* (2013.01)

(58) Field of Classification Search
CPC ..... G09F 17/00; G09F 17/0091; G09F 2017/0008; G09F 2017/005; G09F 2017/0058; G09F 7/22; G09F 2007/1804; G09F 2007/1813; G09F 2007/1817; G09F 2007/1856; G09F 17/18
USPC ..... 116/174, 173; 248/218.4, 219.1, 219.3, 248/219.4, 230.1, 230.8
See application file for complete search history.

(56) References Cited

U.S. PATENT DOCUMENTS 1,855,824 A * 4/1932 Crichton ..... E04H 12/32 116/173
2,368,783 A * 2/1945 Schillinger ..... E04H 12/32 116/174
2,899,764 A * 8/1959 Oberlin ..... G09F 17/00 248/230.5
3,310,899 A * 3/1967 Hart ..... G09F 17/00 160/329
3,593,450 A * 7/1971 Mollet, III ..... G09F 17/00 40/604
3,595,202 A * 7/1971 Visitacion ..... E04H 12/32 116/174
4,095,360 A * 6/1978 Dinan ..... G09F 7/22 40/603
4,402,220 A 9/1983 Kuhlmann
4,880,195 A * 11/1989 Lepley ..... G09F 17/00 248/219.3
5,203,672 A 4/1993 Wolf
5,361,633 A 11/1994 Peet
5,463,973 A * 11/1995 Tait ..... G09F 17/00 116/173

(Continued)

*Primary Examiner* — Ingrid M Weinhold

(57) ABSTRACT

The present invention is a banner support assembly for mounting to poles of any surface or shape. The banner support assembly includes a plurality of pole brackets abutting the outer surface of the pole which are demountably secured at preselected intervals around the pole with at least one band clamp received through band slots defined in each pole bracket. A ring is slideably received within a channel defined in each of the pole brackets such that the ring is free to rotate around the pole about a longitudinal axis of the pole.

13 Claims, 8 Drawing Sheets

(56) References Cited

U.S. PATENT DOCUMENTS

| | | | | |
|---|---|---|---|---|
| 6,192,611 | B1 * | 2/2001 | Molla | G09F 15/0025 160/378 |
| 6,293,221 | B1 * | 9/2001 | Kinahan | G09F 17/00 116/173 |
| 6,338,212 | B1 * | 1/2002 | Santa Cruz | G09F 17/00 40/606.18 |
| 6,378,820 | B1 * | 4/2002 | Mooney | G09F 17/00 116/173 |
| 6,550,170 | B1 * | 4/2003 | Cooper | G09F 15/0037 248/218.4 |
| 6,845,730 | B2 * | 1/2005 | Cardarelli | G09F 17/00 116/173 |
| 7,270,076 | B2 * | 9/2007 | Evans | G09F 17/00 116/174 |
| 7,810,265 | B2 * | 10/2010 | Beatty | G09F 7/18 116/173 |
| 8,733,720 | B2 * | 5/2014 | Wilkinson | G09F 7/002 116/174 |
| 2004/0031433 | A1 * | 2/2004 | Cardarelli | G09F 17/00 116/174 |
| 2009/0146029 | A1 * | 6/2009 | Beatty | G09F 17/00 248/206.5 |
| 2010/0018095 | A1 * | 1/2010 | Molla | G09F 7/22 40/606.16 |
| 2011/0240824 | A1 * | 10/2011 | Wade | G09F 17/00 248/541 |
| 2015/0075045 | A1 * | 3/2015 | Wilkinson | G09F 17/00 40/606.15 |

* cited by examiner

BANNER SUPPORT ASSEMBLY

The present application claims priority from U.S. Provisional application 62/316,026 filed on Mar. 31, 2016 by Rick Ashworth and Scott Kobryn under the title BANNER SUPPORT ASSEMBLY.

FIELD OF THE INVENTION

The present concept relates to devices for attaching a flag to a pole and/or flag pole and more particular devices which permit the flag to revolve about the flag pole according to the direction of the wind without becoming wrapped around the pole.

BACKGROUND OF THE INVENTION

There have been a number of attempts to design an attachment for flag poles and/or other poles which will prevent the flag from becoming entangled with the pole but these devices have disadvantages for a number of reasons that have resulted in most not being commercially feasible. In most cases the devices are overly complicated arrangements that require great amounts of maintenance in order to keep in operation. The other factor is that the cost and expense of installing these prior art devices is so high that it is not viable to use them.

Additionally flags are mounted not only onto flag poles but also onto other posts such as light posts and/or sign posts which have a number of different cross sectional shapes namely round, square and at times hexagonal. There is a need for a banner support assembly which is able to be attached to any type of cross section of pole at any height along the pole and that is simple to attach and inexpensive to manufacture.

There are a number of prior art devices which have attempted to solve one or more of the issues enumerated above namely U.S. Pat. No. 4,402,220 issued to Kuhlmann, U.S. Pat. No. 5,203,672 issued to Wolf, U.S. Pat. No. 5,361,633 issued to Peet, and U.S. Pat. No. 7,270,076 issued to Evans.

There is need to for a banner support assembly which is simply to install, which is inexpensive to manufacture, which is reliable in its operation, which resists corrosion and other effects of the weather upon the banner support assembly and will continue to operate with a minimal amount of maintenance.

SUMMARY OF THE INVENTION

A banner support assembly for mounting to a pole comprising;

a) a pole which includes an outer surface;

b) a plurality of pole brackets abutting the outer surface of the pole and demount-ably secured at preselected intervals around the pole with at least one band clamp received through band slots defined in each pole bracket; and c) a ring slide-ably received within a channel defined in each of the pole brackets such that the ring is free to rotate around the pole about a longitudinal axis of the pole.

Preferably wherein the pole bracket includes a mounting side contacting and abutting the pole outer surface and the channel includes a bearing surface for slideably supporting the ring thereon.

Preferably wherein the pole bracket is C shaped and defines a U shaped channel for receiving the ring therein.

Preferably wherein each pole bracket includes an upper band slot and a lower band slot for receiving band clamps there through such that two band clamps secure the pole brackets to the pole.

Preferably wherein the ring includes a removable segment which is demountable attached to the major segment in order to assemble the ring onto the channel of the pole brackets.

Preferably wherein two vertically spaced apart support assemblies an upper assembly and a lower assembly are mounted on a pole for attaching a flag frame to each ring of each assembly such that the rings and the flag frame rotate about the pole in unison.

Preferably wherein the flag frame includes a vertical strut extending parallel to the longitudinal direction and spaced from the pole and connected to an upper horizontal strut at an upper end with an upper connector and to a lower horizontal strut at a lower end.

Preferably wherein each connector includes a ring landing portion for abutting with and connecting to the ring.

Preferably wherein each connector includes vertical strut channel for receiving the vertical strut there through and a horizontal aperture for receiving a horizontal strut therein.

Preferably wherein the connector is L shaped with a vertical portion and a horizontal portion.

Preferably wherein the flag frame is C shaped.

Preferably wherein the pole is square in cross section and four pole brackets are deployed onto the pole.

Preferably wherein the pole is round in cross section and three pole brackets are deployed onto the pole.

Preferably wherein the pole is hexagonal in cross section and three pole brackets are deployed onto the pole.

DETAILED DESCRIPTION OF THE PREFERRED EMBODIMENTS

Figure 9:
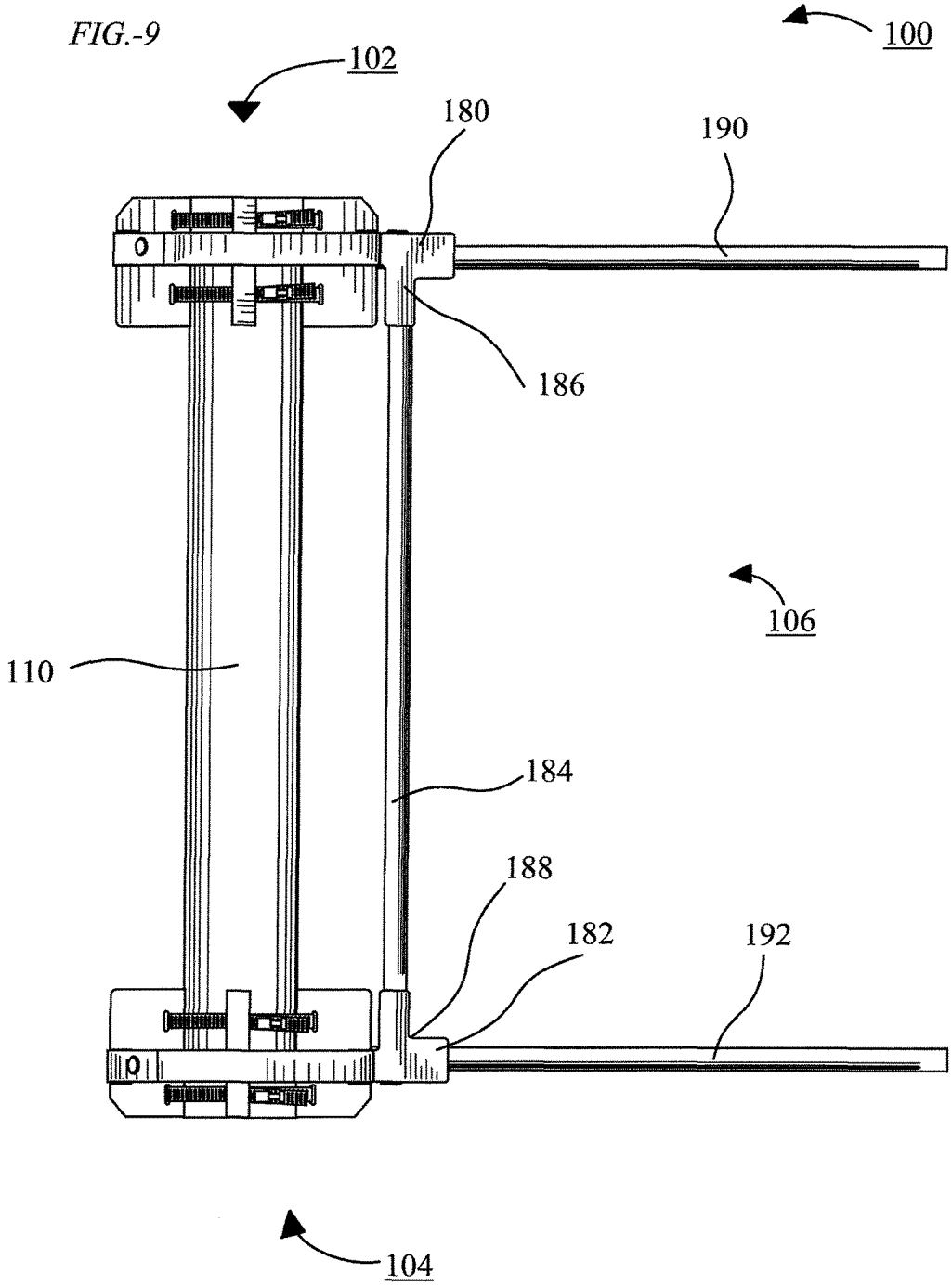
FIG. 9 is a side elevational view of the banner support assembly shown complete with the upper support assembly, the lower support assembly and the flag frame.

Referring first of all to FIG. 9 the banner support assembly shown generally as 100 includes the following major components namely; upper support assembly 102, lower support assembly 104, and flag frame 106.

Banner support assembly 100 is shown deployed on a pole 110 in FIG. 9.

The reader will note that upper support assembly 102 and lower support assembly 104 are very similar.

Therefore by way of example we will first discuss upper support assembly 102 however all of the items discussed in regard to upper support assembly 102 have identical counter parts in lower support assembly 104 as shown in the drawings.

Figure 4:
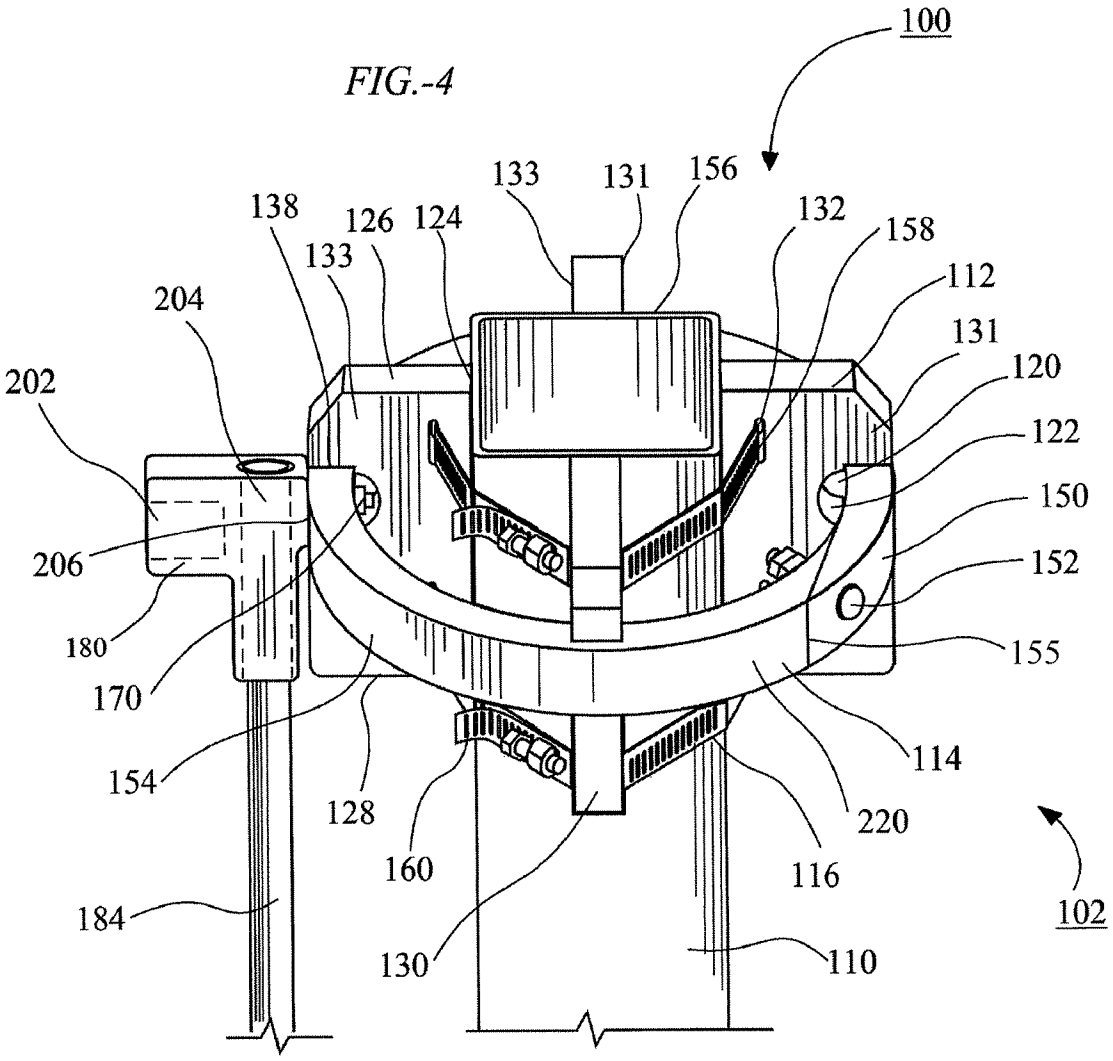
FIG. 4 is a top perspective view showing a portion of the banner support assembly namely upper support assembly.

Banner support assembly 100 preferably includes two support assemblies namely upper support assembly 102 and lower support assembly 104. FIG. 4 depicts upper support assembly 102 and includes the following major components namely pole brackets 112 ring 114 and band clamps 116.

Figure 5:
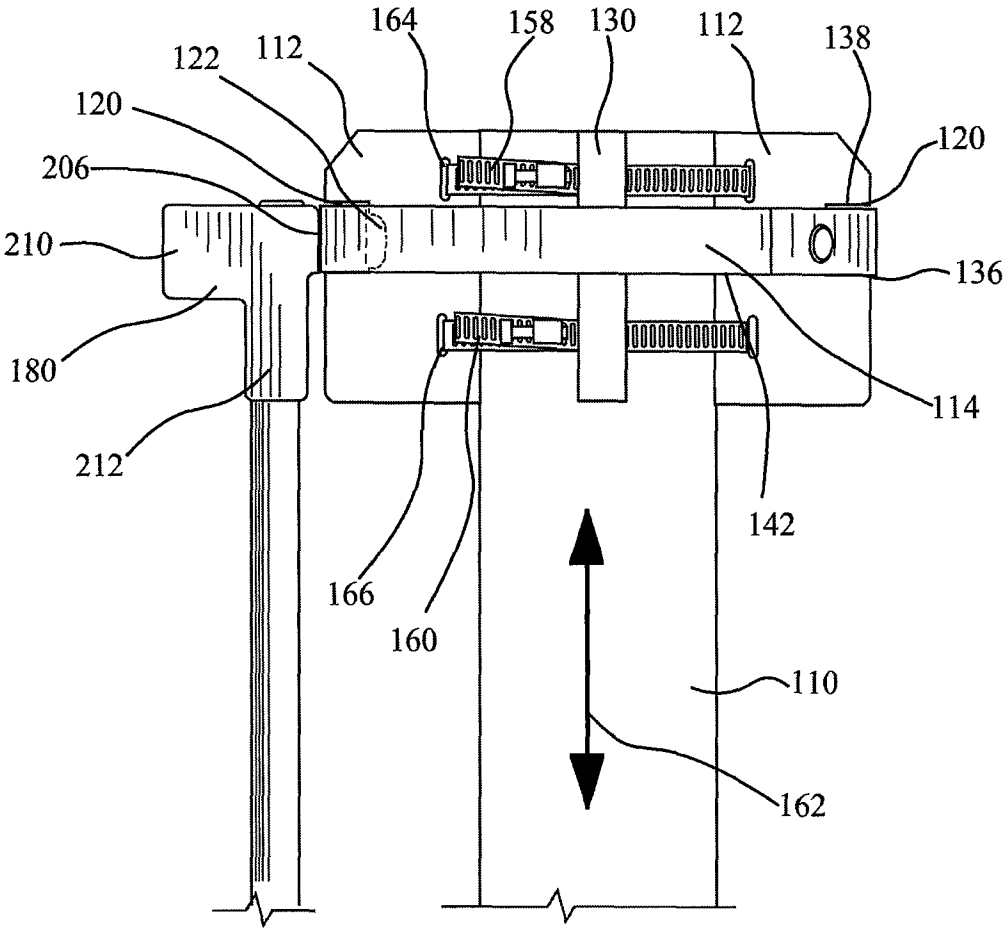
FIG. 5 is a side elevational view of the upper support assembly of the banner support assembly shown in FIG. 4.

The structure of pole bracket 112 is best depicted in FIGS. 4 and 5 and therefore referring now to FIGS. 4 and 5 pole bracket 112 includes a ring channel 120, a relief 122 there behind the ring channel 120, a mounting side 124, a top side 126, a bottom side 128, a front side 130 a first vertical face 131 and an opposed second vertical face 133 and band slots 132. Pole brackets 112 are longitudinally oriented, flat, planar plates mounted at preselected intervals around pole 110 and extend radially away from the pole.

Pole bracket 112 is preferably a "C" shaped bracket 112 as depicted in FIG. 5 wherein the bottom of ring channel 120 is bearing surface 136 and the top of ring channel 120 is retaining surface 138 and ring channel 120 roughly defines a "U" shaped ring channel.

Ring 114 is designed to be slideably received within ring channel 120 such that the ring bottom surface 142 slides along bearing surface 136 of ring channel 120 of each of the pole brackets 112. Ring 114 has a removable segment 150 which is attached with fasteners 152 to a major section 154 of ring 114.

Ring 114 has removable segment 150 in order to be able to mount it around pole 110. Ring 114 therefore includes two split lines 155 which is the connection point between the removable segment 150 and the major segment 154. The split line 155 is flush in other words there is no surface step in the ring bottom surface 142 and in particular when going from the major segment 154 of ring 114 to the removable segment 150.

Upper support assembly 102 is attached to an outer surface 156 of pole 110 using band clamp 116 which is fed through band slots 132.

It is possible that only one band clamp 116 is necessary in order to attach upper support assembly 102 to pole 110 however preferably two band clamps 116 are used namely upper band 158 and lower band 160 are used to mount the pole brackets 112 onto the outer surface 156 of pole 110.

The reader will note that the mounting side 124 of pole bracket 112 abuts against the outer surface 156 of pole 110 and is compressively held against the outer surface 156 of pole 110 by tightening and shortening the length of the band clamps 116. Therefore preferably there is an upper band 158 and a lower band 160 wherein the upper band 158 passes through upper slots 164 and the lower band 160 passes through lower slots 166.

Ring channel 120 also preferably has a relief 122 in order that the fastener 152 of ring 114 can pass there-through and also the fastener 170 of connector 172 may also pass through relief 122.

The reader will note that ring 114 is free to rotate about a longitudinal direction 162, as it slideably rides on bearing surface 136 of the pole brackets 112.

Figure 6:
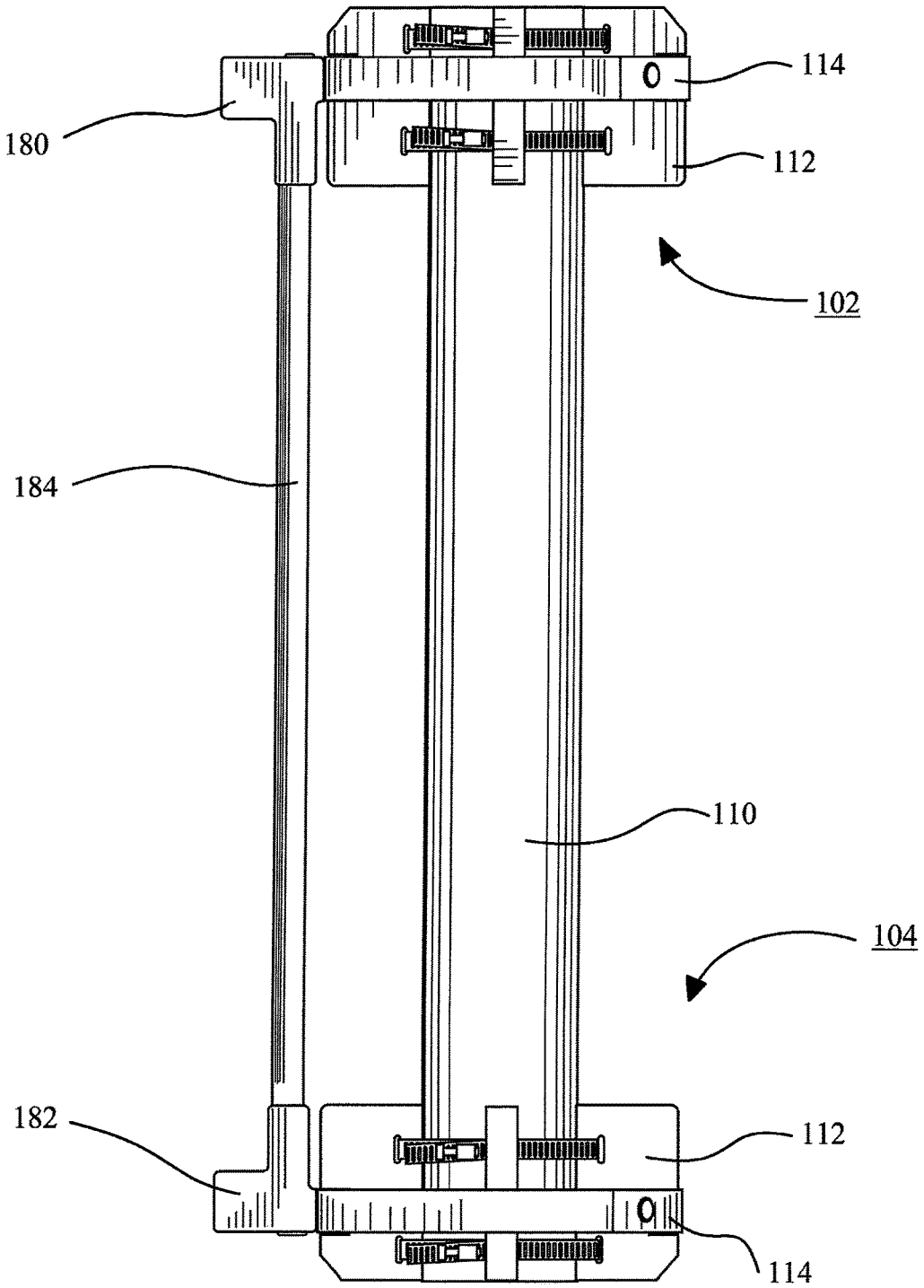
FIG. 6 is a partial side elevational view showing the upper support assembly and the lower support assembly and parts of the flag frame.
Figure 7:
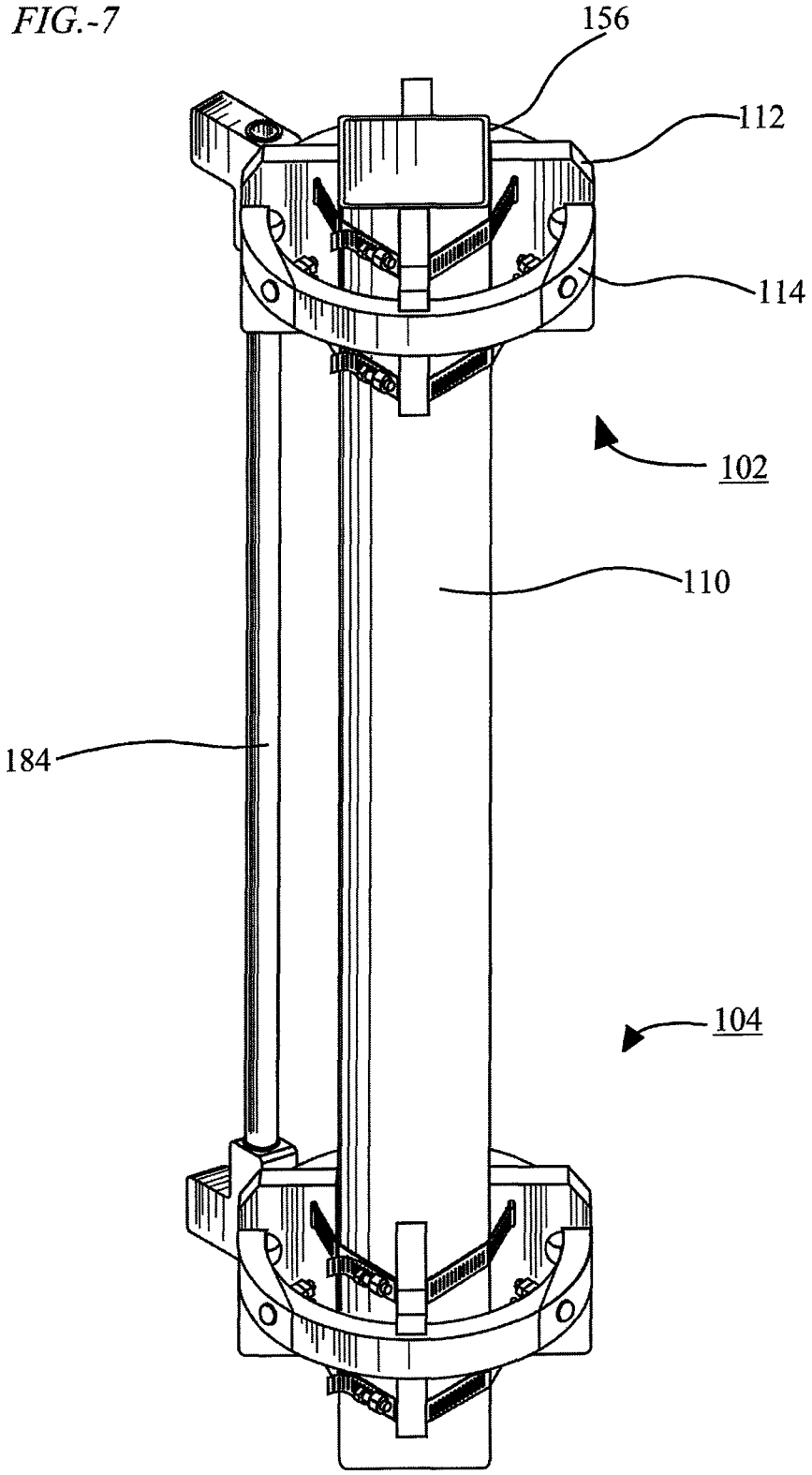
FIG. 7 is a top perspective view of the banner support assembly.
Figure 8:
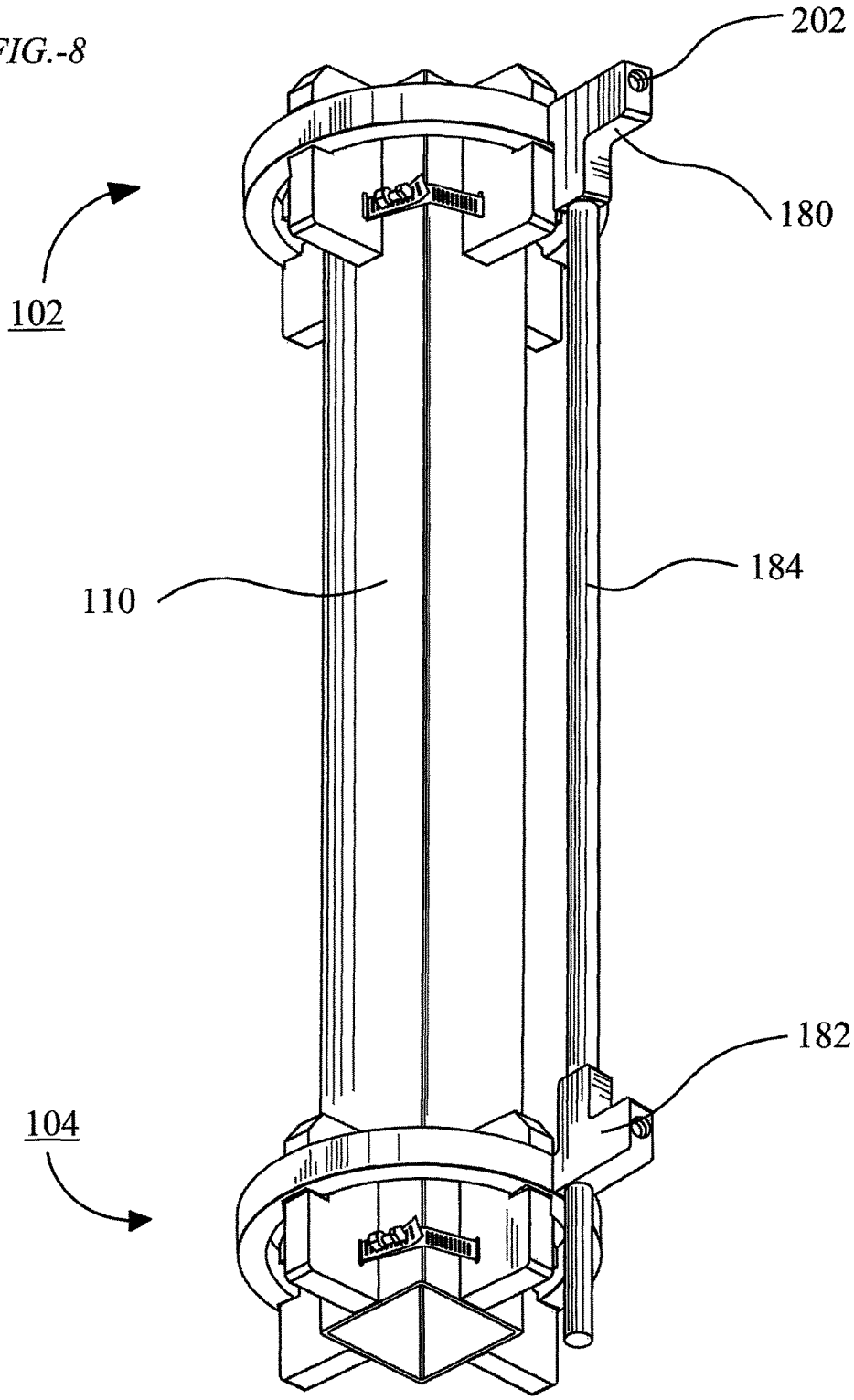
FIG. 8 is a bottom perspective view of the banner support assembly.

Referring to FIG. 6 the reader will note that preferably there are two support assemblies namely upper support assembly 102 and lower support assembly 104 which are attached to pole 110.

FIG. 9 depicts a flag frame 106 connected to the upper and lower support assemblies 102 and 104 respectively using upper connector 180 and a lower connector 182. A vertical strut 184 spans between upper connector 180 and 182 in the vertical direction wherein an upper end 186 of vertical strut 184 connects to upper connector 180 and a lower end 188 of vertical strut 184 connects to lower connector 182.

An upper horizontal strut 190 attached to upper connector 180 and extends perpendicularly away from pole 110 and vertical strut 184. Similarly a lower horizontal strut 192 is connecter to lower connector 182 and extends horizontally perpendicularly away from vertical strut 184 and pole 110.

Upper connector 180 and lower connector 182 are the same other than lower connector 182 is the mirror image of upper connector 180 and is positioned inverted relative to upper connector 180.

Referring now to FIGS. 4 and 5, upper connector 180 includes a horizontal portion 210, a vertical portion 212 and is generally an "L" shaped connector.

The horizontal portion 210 of upper connector 180 includes a horizontal aperture 202 for receiving horizontal struts 190 and 192 therein.

The vertical portion 212 of upper connector 180 includes vertical strut channel 204 for receiving vertical strut 184 there-through.

Upper connector 180 is fastened to ring 114 at a ring landing portion 206 which abuts and contacts with the outer surface 220 of ring 114.

The reader will note flag frame 106 is a "C" shaped flag frame as depicted in FIG. 9.

Figure 10:
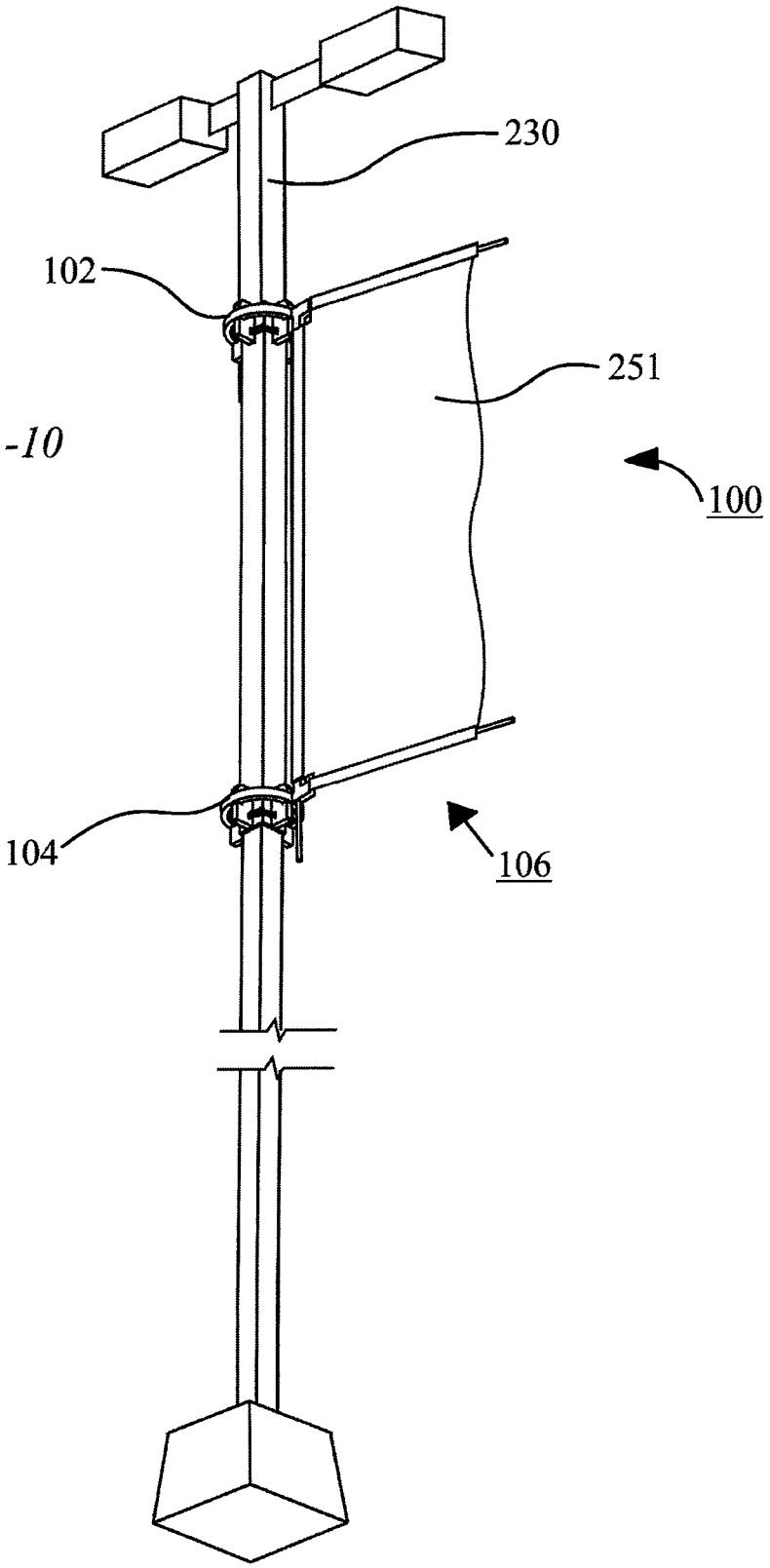
FIG. 10 is a bottom perspective schematic view of the banner support assembly 100 deployed onto a light standard or pole.

Referring to FIG. 10 the banner support assembly 100 is shown deployed onto a light pole or light standard 230 wherein upper support assembly 102 is connected to an upper portion of light pole 230 and lower support assembly 104 is connected to lower portion of light pole 230 and flag frame 106 is connected to both the upper support assembly 102 and lower support assembly 104 using upper connectors 180.

The flag frame 106 together with flag 251 is free to rotate around pole 110 since it is connected to rings 114 at both the upper support assembly 102 and lower support assembly 104.

Figure 1:
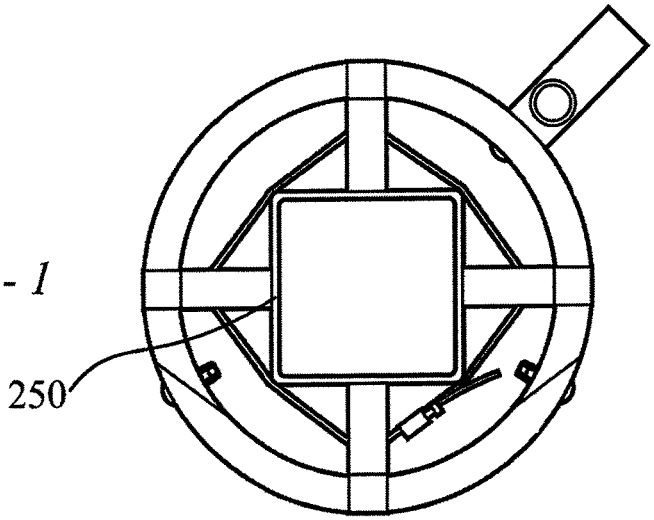
FIG. 1 is cross sectional view of the present concept a banner support assembly shown deployed on a square pole.
Figure 2:
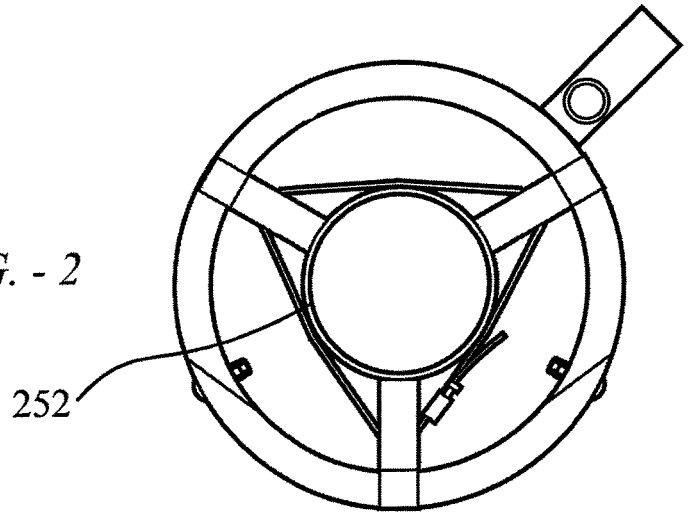
FIG. 2 is cross sectional view of the present concept a banner support assembly shown deployed on a round pole.
Figure 3:
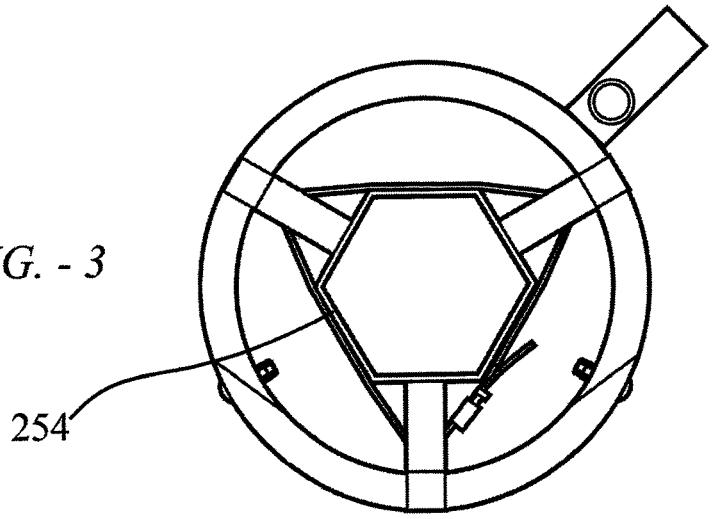
FIG. 3 is cross sectional view of the present concept a banner support assembly shown deployed on a hexagonal pole.

Referring now to FIGS. 1, 2 and 3 upper support assembly 102 is shown deployed onto a square pole 250 in FIG. 1, deployed onto round pole 252 in FIG. 2 and deployed onto a hexagonal pole 254 in FIG. 3, such that pole bracket 112 and therefore banner support assembly can be attached to any commercially used pole geometry without modification.

It should be apparent to persons skilled in the arts that various modifications and adaptation of this structure described above are possible without departure from the spirit of the invention the scope of which defined in the appended claim.

We claim:

1. A banner support assembly for mounting to a pole having an outer surface, the banner support assembly comprises an upper support assembly which includes:

a) a plurality of pole brackets, each including a mounting side configured to abut the outer surface of the pole and demountably securable at preselected intervals around the pole with at least one band clamp which is received through a band slot defined in each of the pole brackets such that the pole brackets and therefore the banner support assembly is mountable onto a round, square, or hexagonal pole;

b) a ring slideably received within a channel defined in each of the pole brackets such that the ring is free to rotate around the pole about a longitudinal axis of the pole; and c) wherein the pole brackets are planar plates, each with first and second opposed vertically oriented faces, wherein when the pole brackets are mounted upon the pole, the first and second opposed vertically oriented faces are configured to be parallel to the longitudinal axis of the pole and extending radially away from the pole.

2. The banner support assembly claimed in claim 1 wherein each pole bracket is C shaped which defines the channel as a U shaped channel for receiving the ring therein.

3. The banner support assembly claimed in claim 2 wherein the at least one band clamp comprises two band clamps, and wherein the band slot in each pole bracket is an upper band slot and each pole bracket further includes a lower band slot, each of the upper and lower band slots for receiving one of the two band clamps there through such that the two band clamps are configured to secure the pole brackets to the pole.

4. The banner support assembly claimed in claim 1 wherein the ring includes a removable segment which is demountably attached to a major segment in order to assemble the ring onto the channel of the pole brackets.

5. The banner support assembly claimed in claim 1, which further includes a lower support assembly wherein the upper support assembly and a the lower support assembly are vertically spaced apart and are mountable on the pole for attaching a flag frame to the ring of the upper support assembly and a ring of the lower support assembly such that the rings and the flag frame are rotatable about the pole in unison.

6. The banner support assembly claimed in claim 5 wherein the flag frame includes a vertical strut connected to an upper horizontal strut at an upper end with an upper connector and to a lower horizontal strut at a lower end with a lower connector, wherein the flag frame is configured to extend parallel to the longitudinal axis of the pole and be spaced from the pole.

7. The banner support assembly claimed in claim 6 wherein the upper connector includes a ring landing portion for abutting with and connecting to the ring of the upper support assembly.

8. The banner support assembly claimed in claim 7 wherein the upper connector and the lower connector each include a vertical strut channel for receiving the vertical strut there through and a horizontal aperture for receiving the upper and lower horizontal struts respectively therein.

9. The banner support assembly claimed in claim 8 wherein the upper connector and the lower connector are each L shaped with a vertical portion and a horizontal portion.

10. The banner support assembly claimed in claim 6 wherein the flag frame is C shaped.

11. The banner support assembly claimed in claim 1 wherein the plurality of pole brackets includes four pole brackets configured to be deployed onto the pole when the pole has a square cross-section.

12. The banner support assembly claimed in claim 1 wherein the plurality of pole brackets includes three pole brackets configured to be deployed onto the pole when the pole has a round cross-section.

13. The banner support assembly claimed in claim 1 wherein the plurality of pole brackets includes three pole brackets configured to be deployed onto the pole when the pole has a hexagonal cross-section.

* * * * *